US005111618A

United States Patent [19]

Kaspar et al.

[11] Patent Number: 5,111,618

[45] Date of Patent: * May 12, 1992

[54] REFRIGERATOR DOOR ASSEMBLY WITH STYLIZED SUBSTANTIALLY ALL GLASS FRONT

[75] Inventors: Melvin Kaspar; Jeffrey Kostos, both of LaGrange Park; Matthew Rolek, Chicago; Paul Artwohl, Flossmoor, all of Ill.

[73] Assignee: Ardco, Inc., Chicago, Ill.

[ * ] Notice: The portion of the term of this patent subsequent to Mar. 12, 2008 has been disclaimed.

[21] Appl. No.: 668,135

[22] Filed: Mar. 12, 1991

Related U.S. Application Data

[60] Continuation-in-part of Ser. No. 602,791, Oct. 24, 1990, Pat. No. 5,024,023, which is a division of Ser. No. 448,328, Dec. 11, 1989, Pat. No. 4,998,382.

[51] Int. Cl.[5] ..... E06B 3/00

[52] U.S. Cl. ..... 49/501; 49/DIG. 1; 49/504; 52/790

[58] Field of Search ..... 49/401, 402, 400, 478, 49/501, 504, DIG. 1; 52/208, 397, 398, 788, 789, 790, 821; 156/100

[56] References Cited

U.S. PATENT DOCUMENTS

| | | | |
|---|---|---|---|
| 1,805,969 | 5/1931 | Bostrom . | |
| 2,205,522 | 6/1940 | Fix . | |
| 2,834,999 | 5/1958 | Taylor et al. . | |
| 2,877,515 | 3/1959 | Haas | 52/398 X |
| 3,499,245 | 3/1970 | Winsler et al. . | |
| 3,971,178 | 3/1976 | Mazzoni et al. . | |
| 3,975,881 | 8/1976 | Ninowski, Jr. . | |
| 4,138,284 | 2/1979 | Postupack . | |
| 4,145,844 | 3/1979 | Kasper | 49/501 X |
| 4,514,948 | 5/1985 | Meigs et al. . | |
| 4,604,840 | 8/1986 | Mondon . | |
| 4,637,167 | 1/1987 | Svensson . | |
| 4,719,728 | 1/1988 | Eriksson et al. . | |
| 4,741,127 | 5/1988 | Bockwinkel . | |
| 4,753,843 | 6/1988 | Bockwinkel . | |
| 4,817,335 | 4/1989 | Adell . | |
| 4,825,609 | 5/1989 | Rundo . | |
| 4,831,780 | 5/1989 | Bockwinkel . | |
| 4,852,303 | 8/1989 | Rolek . | |
| 4,873,803 | 10/1989 | Rundo . | |
| 4,948,206 | 8/1990 | Fitzpatrick . | |
| 4,998,382 | 3/1991 | Kostos et al. | 49/504 X |
| 5,024,023 | 6/1991 | Kostos et al. | 49/501 |
| 5,035,085 | 7/1991 | Mamelson et al. | 49/504 |

FOREIGN PATENT DOCUMENTS

| | | | |
|---|---|---|---|
| 408440 | 3/1969 | Australia | 156/100 |
| 2754453 | 6/1979 | Fed. Rep. of Germany | 52/398 |
| 733445 | 7/1955 | United Kingdom | 52/398 |

*Primary Examiner*—Renee S. Luebke
*Assistant Examiner*—Jerry Redman
*Attorney, Agent, or Firm*—Leydig, Voit & Mayer

[57] ABSTRACT

A multi-pane insulated glass door assembly in which the forward pane of the glass unit extends outwardly a greater distance than the panes rearwardly thereof and is supported by an outer metal frame having a relatively narrow forwardly extending perimeter portion adjacent the peripheral edge of the forward glass pane so as to provide the door with a modernistic, substantially all glass front appearance. In one embodiment, the outer metal frame has a rear portion extending inwardly behind the forward glass pane and a moulding is interposed between the forwardly extending perimeter portion of the metal frame and the peripheral edge of the forward glass pane to provide a finished appearance. A dark ink is affixed to an inside peripheral face of the forward glass pane for masking the peripheral components of the door assembly from sight through the forward glass pane from the front side thereof. In another embodiment, each door has a non-metallic, lightweight outer molded trim portion which encapsulates the outer support frame and the periphery of the glass unit and which has insulating qualities that tends to prevent heat transfer between warm and cold sides of the door.

17 Claims, 5 Drawing Sheets

FIG. 3
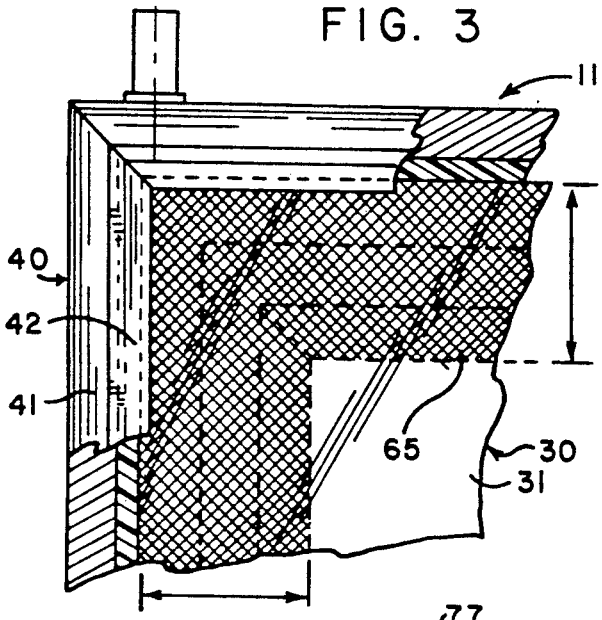
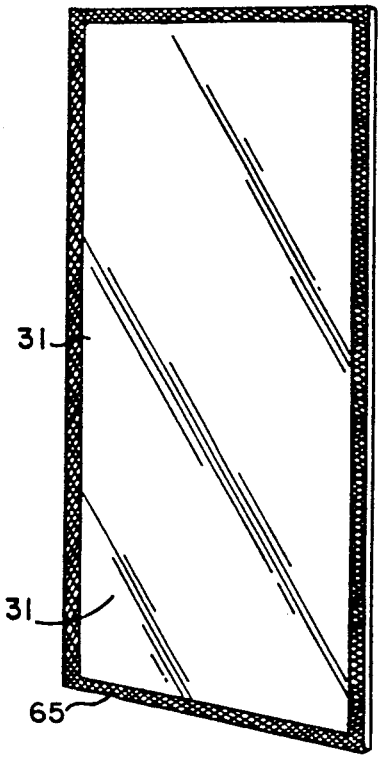
FIG. 4
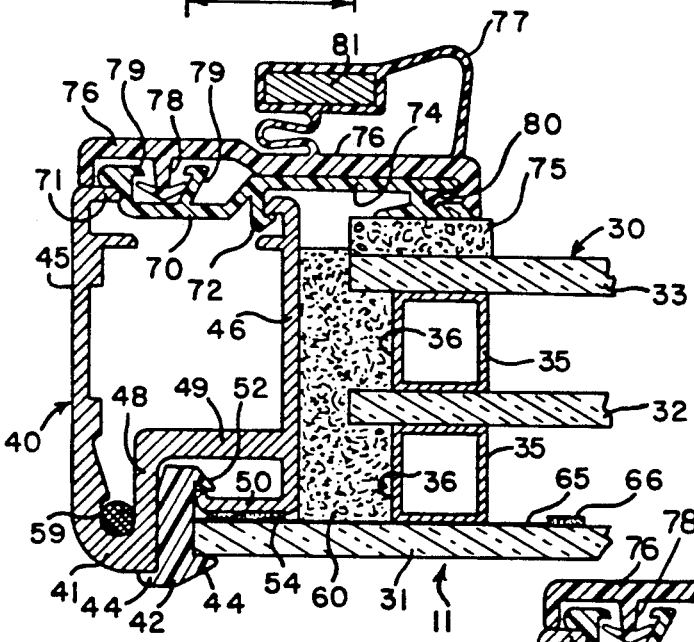
FIG. 5
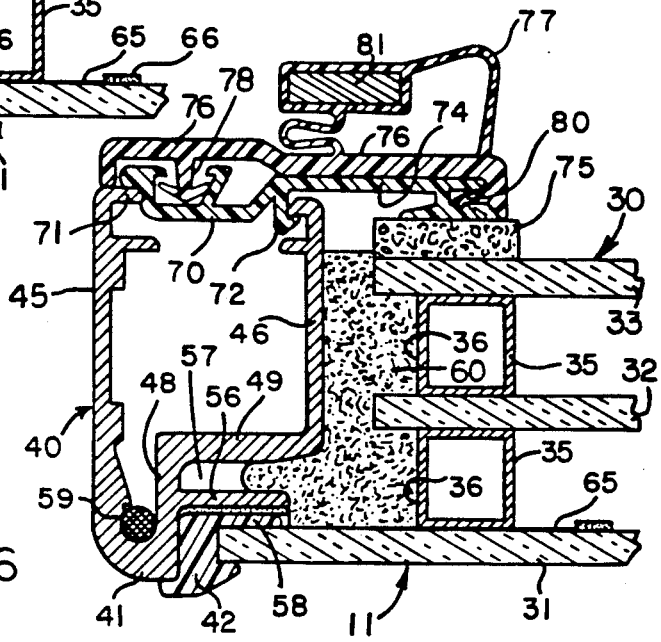
FIG. 6

REFRIGERATOR DOOR ASSEMBLY WITH STYLIZED SUBSTANTIALLY ALL GLASS FRONT

RELATED APPLICATIONS

This is a continuation-in-part of application Ser. No. 07/602,791, filed Oct. 24, 1990 now U.S. Pat. No. 5,024,023, which in turn was a division of application Ser. No. 07/448,328 filed Dec. 11, 1989 now U.S. Pat. No. 4,998,382.

FIELD OF THE INVENTION

The present invention relates generally to insulated glass doors, and more particularly, to multi-pane insulated glass door assemblies such as used in commercial refrigeration and freezer units.

BACKGROUND OF THE INVENTION

For over thirty years, insulated glass door assemblies for commercial refrigerator and freezer insulations have comprised an insulated glass unit made up of two or more glass panes maintained in spaced-apart relation by tubular spacers with the interior between the panes appropriately sealed. The glass unit in turn is supported within a relatively rugged outer metallic frame, commonly formed from aluminum extrusions, with the metal frame overlapping the periphery of the glass unit for retaining the glass unit in position and for providing a decorative finished appearance to the door assembly. While improvements in energy efficiencies, structural rigidity, and mounting of such door assemblies have taken place over the years, such insulated glass door assemblies have remained substantially unchanged in their outer appearance. Although the desire for style changes has existed, cost considerations usually have prevented product changes.

Because of increasing customer demand for styling changes, manufacturers recently have introduced more modernistic appearing glass door assemblies. These doors have included a single, relatively thick pane that provides the appearance of an all-glass, relatively contemporary, front to the door assembly. While such doors are attractive in appearance, they do not have the efficiency, safety, and durability features the industry has grown to expect in commercial insulated refrigerator door assemblies and have been unable to withstand the relatively abusive use in commercial establishments where doors are repeatedly opened and closed and are frequently struck by shopping carts and the like.

To provide necessary rigidity and durability in conventional refrigerator door assemblies, costly manufacturing procedures heretofore have been required. It is customary to first assemble the insulated glass unit and then fabricate the outer support frame thereon. The latter commonly requires accurate forming of mitered corners of the metal frame members and precision assembly techniques for establishing the necessary squareness. Such fabrication not only is expensive, but unless properly effected, during rigorous use of the door in commercial establishments the components of the frame and glass unit can become separated and destroy the sealed condition to the interior of the glass unit. Moreover, because the outer support frame of such conventional doors is made of metal, it is highly heat conducted and can require electrical heating means for maintaining the portion of the frame exposed to the warmer ambient air at a sufficiently high temperature to prevent condensation build up. Such electrical heating capability not only adds to the manufacturing cost of the door, but increases the operating cost of the refrigeration unit with which the door is used.

Furthermore, in order to maintain the forward glass pane in a frost-free, clear condition, which is essential for aesthetic viewing of merchandise through the door in commercial refrigeration and freezer installations, it is customary to provide a conductive coating on an inside surface of the forward glass pane and to communicate electric current to the coated surface through bus bars mounted on opposite sides thereof. Since the bus bars conduct electric current, it is necessary that they be spaced apart from other possible conductive elements or materials in the glass unit, such as the metallic spacers and carbon containing polyisolbutylene commonly used as the sealant between the spacers and the glass panes. As a result, it has become the practice to position the bus bars on the exposed surface of the forward glass pane inwardly away from the metal spacers a distance of about ¼ inch. Because the bus bars typically have a width of about ¼ inch, they not only tend to detract from the aesthetic appearance of the door, but also reduce the unobstructed viewing area through the glass pane by about ½ inch on each side.

OBJECT AND SUMMARY OF THE INVENTION

It is an object of the present invention to provide an insulated refrigerator door assembly which has a modernistic, stylized appearance, but that retains the efficiency and structural features to which the industry has grown accustom over the years.

Another object is to provide an insulated glass door assembly as characterized above which has a substantially all-glass contemporary front appearance.

A further object is to provide an insulated glass door assembly of the above kind which has an appearance that is distinct from conventional refrigerator glass door assembly over the years, but which can be constructed in substantially similar manner, and hence, lends itself to manufacture by existing production techniques.

Still another object is to provide an insulated modern appearing glass door assembly which has a non-metallic, outer lightweight frame and trim portion that can be inexpensively formed and which has insulating qualities. A related object is to provide such an insulated glass door assembly in which the non-metallic outer trim portion rigidifies the assembly and assists in preventing the infiltration of air and moisture into the interior of the glass unit.

Other objects and advantages of the invention will become apparent upon reading the following detailed description and upon reference to the drawings, in which:

BRIEF DESCRIPTION OF THE DRAWINGS

FIG. 3 is an enlarged partial plan view of a corner of one of the doors of the illustrated assembly with portions broken away;

FIG. 4 is a perspective of a rear side of the forward glass pane of one of the doors of the illustrated assembly;

FIG. 5 is an enlarged fragmentary section of one of the doors of the illustrated assembly;

FIG. 6 is an enlarged fragmentary section, similar to FIG. 5, but showing an alternative embodiment of door construction;

Figure 1:
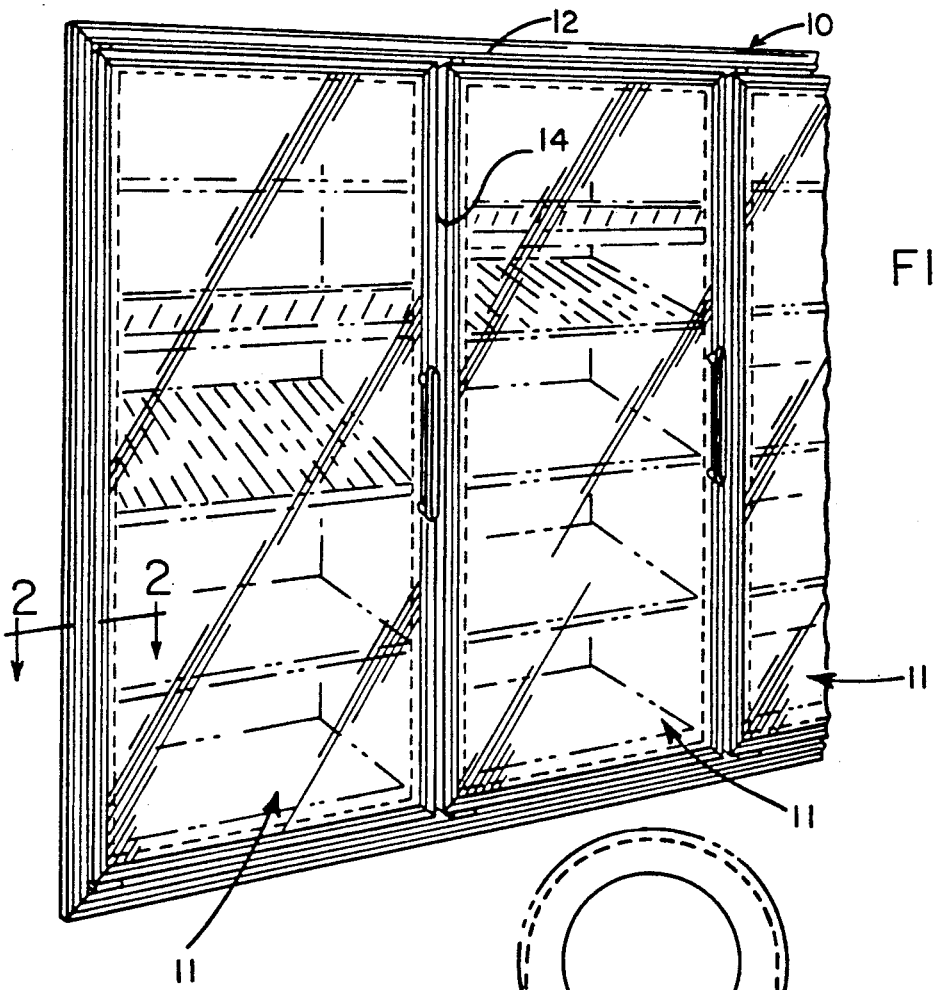
FIG. 1 is a perspective of a refrigerator door assembly having a plurality of insulated glass doors embodying the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DESCRIPTION OF THE PREFERRED EMBODIMENT

Referring now more particularly to the drawings, there is shown an illustrative refrigerator door assembly 10 comprising a plurality of insulated glass doors 11 embodying the present invention each mounted for swinging movement in a door mounting cabinet frame 12, which in turn is mounted within an opening in a front wall 13 of a refrigerator cabinet or the like. It will be understood that the door assembly 10 is particularly adapted for use in free standing refrigerator or freezer cases or built-in coolers or cabinets of the type used in supermarkets and other retail stores to display refrigerated or frozen merchandise. The door mounting frame 12, which may be of a conventional construction, extends about the periphery of the opening in the wall 13 and includes a plurality of mullions 14 that extend vertically between the top and bottom perimeters of the frame to provide rigidity for the frame 12 and define sealing surfaces against which the free swinging sides of the doors 11 engage when in a closed condition.

The cabinet frame 12 includes a plurality of frame members 15, preferably in the form of extrusions made of aluminum or other suitable metal material, arranged in a rectangular configuration about the periphery of the cabinet opening. The illustrated frame members 15 have a generally Z-shaped configuration comprising a front flange 16, a rear flange 18, and a web 19 extending therebetween. The front and rear flanges 16, 18 project in opposite directions, generally at right angles to the web 19. The rear flange 18 defines a plurality of channels 20 which are adapted to receive one or more electrical heating cables 21 or the purpose of maintaining the extrusion at a temperature sufficient to avoid a build up of condensation. An appropriate insulating material 23 also may be provided. The rear flange 18 has a removable cover plate 22 which encloses the channels 20 and provides a sealing surface against which the doors close. An insulating strip 24, preferably made of plastic, is interposed between the frame member web 19 and the cabinet wall 13 and in this case also encompasses a rear side of the flange 18. For illuminating the interior of the cabinet, a light fixture 25 may be mounted on the flange 18 in rearwardly extending fashion.

The insulated glass doors 11 each include an insulated glass unit 30 comprising a plurality of glass panes, 31, 32, 33, disposed in parallel side-by-side relation with a spacer 35 interposed between adjacent panes. The illustrated glass unit 30 includes a forward plane 31 disposed on the front or ambient air side of the door, a rear plant 33 disposed on the rear or refrigerated side of the door, and an intermediate pane 32 disposed between the forward and rear panes 31, 33. As is known in the art, each spacer 35 may comprise a plurality of elongated metal tubular members disposed in a rectangular arrangement between the respective adjacent glass panes, and in this case, each spacer is located inwardly a distance from the peripheral edges of the glass panes so as to define outwardly opening channel areas 36 about the perimeter of the glass unit 30. An appropriate sealant, such as polyisolbutylene is provided between the sides of the spacers 35 and the adjacent glass panes 31, 32, 33 for establishing a primary vapor seal. For supporting the glass unit 30, each door 11 has an outer metal frame 40, preferably assembled from a plurality of extrusions made of aluminum or other suitable metal, which are disposed about the periphery of the glass unit 30 and joined together by suitable corner keys as is known in the art.

In accordance with the invention, the forward pane of each door extends substantially to the outer perimeter of the door for providing a modernistic, substantially all-glass front appearance to the door. To this end, the outer metal frame 40 has a relatively small-sized, forward perimeter portion 41 extending into the plane of the forward glass pane 31 in close outwardly spaced relation to the peripheral edge thereof and a moulding 42 is interposed in slightly overlapping relation between the outer peripheral edge of the forward glass pane 31 and the forward metal frame portion 41 for filling the space therebetween and for providing a relative smooth finished appearance to the front side of the door. The forward metal frame perimeter portion 41 in this instance extends outwardly a relatively small distance beyond the plane of the front face of the forward glass pane 31 and the moulding 42 has a forward, relatively flat head portion with lips 44 overlapping respective peripheral edge portions of the forward glass pane 31 and the forward metal frame portion 41. From a front perspective, the door 11 has a flat substantially all-glass front appearance with the forward glass pane 31 extending outwardly substantially to the outer perimeter of the door, in distinct contrast to conventional commercial refrigerator doors in which the outer metal frame significantly overlaps the front face of the forward glass pane to provide a decorative trim about the door. In carrying out the invention, the forward glass pane extends outwardly a distance greater than the intermediate and rear planes 32, 33 and the metal door frame 40 has a rear portion extending inwardly behind the forward glass pane 31 in outwardly spaced relation the outer peripheral edges of the intermediate and rear panes 32, 33. As best shown in FIG. 5, the metal frame 40 in this case has a rearwardly opening channel shape with outer and inner side walls 45, 46 disposed in parallel relation to each other. The outer side wall 45 is located in outwardly spaced relation to the periphery glass unit and forms one side of the forwardly extending frame perimeter portion 41, which has a general U-shaped configuration, the other side 48 of which is connected to the inner side wall 46 by a transverse wall 49 located rearwardly of the rear face of the forward glass pane 31. The inner side wall 46 of the metal frame 40 in this instance is formed with an outwardly extending flange 50 in closely adjacent parallel relation so the rear face of the forward glass pane 31 and extends to the peripheral edge of the forward glass pane 31. The terminal end of the flange 50 and the side 48 of the perimeter portion 41 define an opening through which the moulding 42 extends. The moulding 42 in this case has a rear inwardly extending lip 52 that is engageable with the terminal end of the flange 50 for retaining the moulding in a mounted position. A foam adhesive tape 54 is interposed between the forward side of the flange 50 and the rear face of the forward glass pane 31. It will be appreciated by one skilled in the art that the flange 50 also may serve as a screw top to prevent fastening screws utilized in securing corner key elements in the outer metal frame from engaging and possibly damaging the forward glass pane 31. Alternatively, as shown in FIG. 6, the side 48 of the frame perimeter portion 41 may be formed with a rear L-shaped leg 58 retained between the flange 56 and forward glass pane 31. An electrical heating wire 59 may be provided in the frame perimeter portion 41 in a passageway between the sides 45, 48, if necessary.

For retaining the glass unit 30 within the outer metal frame 40, the area between the spacers 35, the frame side wall 46, and the rear face of the forward glass pane 31 is filled with an adhesive 60, such as polysulfide. The ends of the glass panes protruding beyond the spacers 35 enhance securement of the glass unit by the adhesive 60. In the embodiment of FIG. 6, the adhesive extends into a channel 57 defined between the transverse wall 49 and the flange 56.

Figure 2:
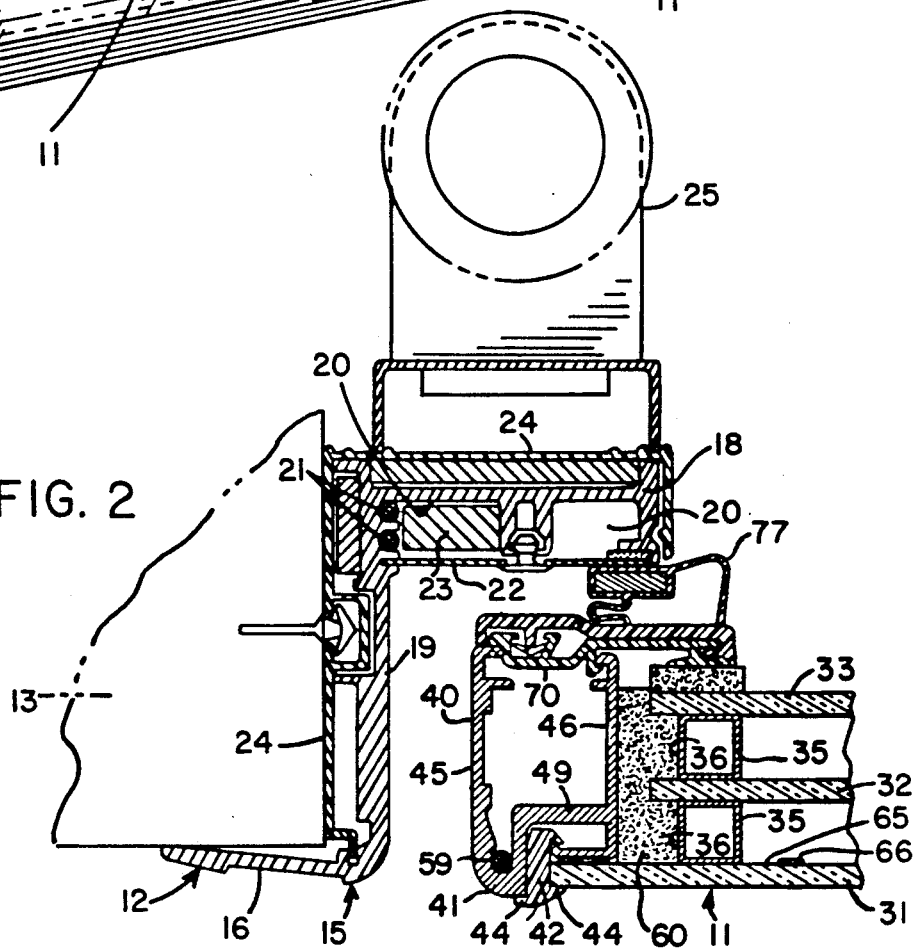
FIG. 2 is an enlarged fragmentary section taken in the plane of line 2—2 in FIG. 1.
Figure 7:
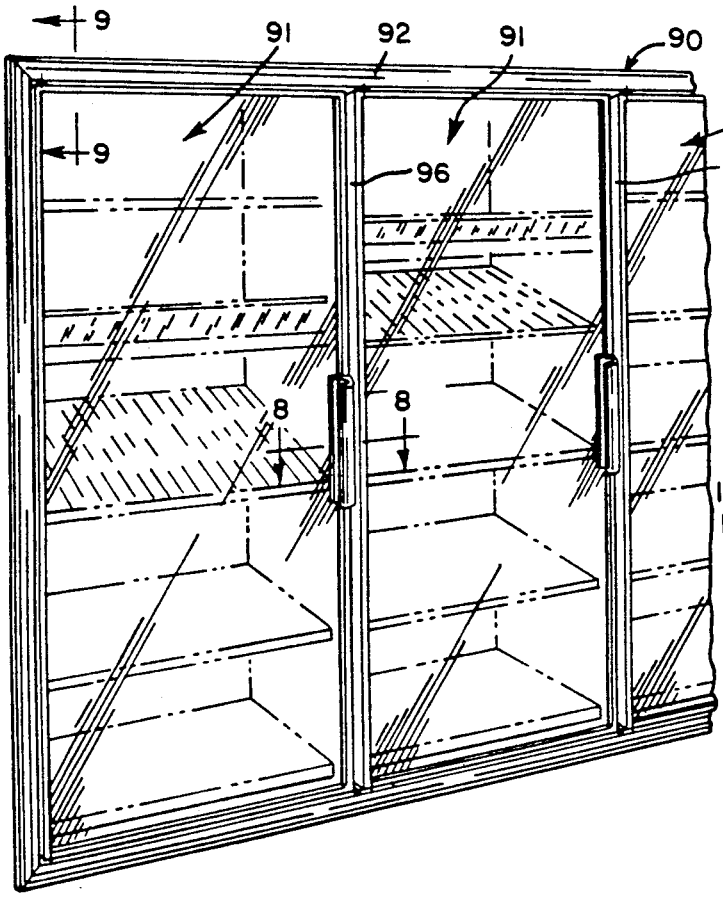
FIG. 7 is a perspective of a refrigerator door assembly having an alternative embodiment of insulated glass doors embodying the present invention.

In carrying out a further aspect of the invention, peripheral masking means is provided on the inner face of the forward glass pane for preventing viewing of the inner components of the door assembly through the forward glass pane from the front side thereof. In the illustrated embodiment, the masking is in the form of a dark silkscreen or ink 65 applied to the inner face of the forward glass pane 31 about its periphery, as shown in FIGS. 2 and 4. The masking 65 preferably extends from the peripheral edge of the glass pane 31 inwardly beyond the spacers 35 a distance so as to cover from view the inner portion of the frame 40 behind the glass pane 31, the adhesive tape 54, the polysulfide adhesive 60, the spacers 35, and the sealant between the spacers 35 and the forward glass pane 31. The dark colored silkscreen or ink 65 has been found to effectively mask such inner door assembly components, while at the same time enhancing the modernistic substantially all-glass front appearance for the door. A silkscreen bar 66 also may be applied to the inner face of the forward glass pane 31 to facilitate heating of the forward pane by conventional means if required.

For enclosing of a rear side of the metal frame 40 and covering the juncture between the rear side of the glass unit 30 and the outer metal frame 40, a back moulding 70, preferably made of aluminum, is adapted for snap action engagement between inwardly turned flanges 71, 72 of the outer frame side walls 45, 46. The back moulding 70 has an inwardly extending leg 74 secured to a rear face of the glass pane 33 by means of a double sides cellular foam tape 75.

For providing a seal between the door 11 and cabinet frame 12 when the door is in a closed position, a gasket sealing strip 76 is secured to the rear side of the moulding 70. The illustrated sealing strip 76, as best shown in FIG. 5, is formed with a T-shaped anchor 78 that is positively retained within inwardly extending retaining members 79 of the moulding 70, and the inner end of the sealing strip 76 has a U-shaped retaining flange 80 adapted for positive engagement with an inner end of the moulding 70. The sealing strip 76 has a gasket portion 77 which contains magnets 81 for creating a magnetic attraction with the cabinet frame cover plate 22, which may be made of stainless steel or other suitable magnetic material.

Referring now to FIGS. 7-17, there is shown an alternative embodiment of a refrigerator door assembly according to the present invention. The door assembly 90 comprises a plurality of insulated glass doors 91 each mounted for swinging movement in a door mounting cabinet frame 92. As previously described, the cabinet frame 92 includes a plurality of generally Z-shaped frame members 94 disposed about the perimeter of the refrigerator wall opening, each having a sealing plate 95, and a plurality of vertically extending mullions 96 against which the free swinging sides of the doors 91 close. The mullions 96 each comprise a structural member 97 having a plastic insulating assembly 98 mounted about forward and opposed sides thereof, which in turn supports a sealing plate 99. The insulated glass doors 91 each include an insulated glass unit 100 comprising a plurality of glass panes 101, 102, 103, disposed in parallel side-by-side relation with a spacer 105 interposed between adjacent planes.

Figure 8:
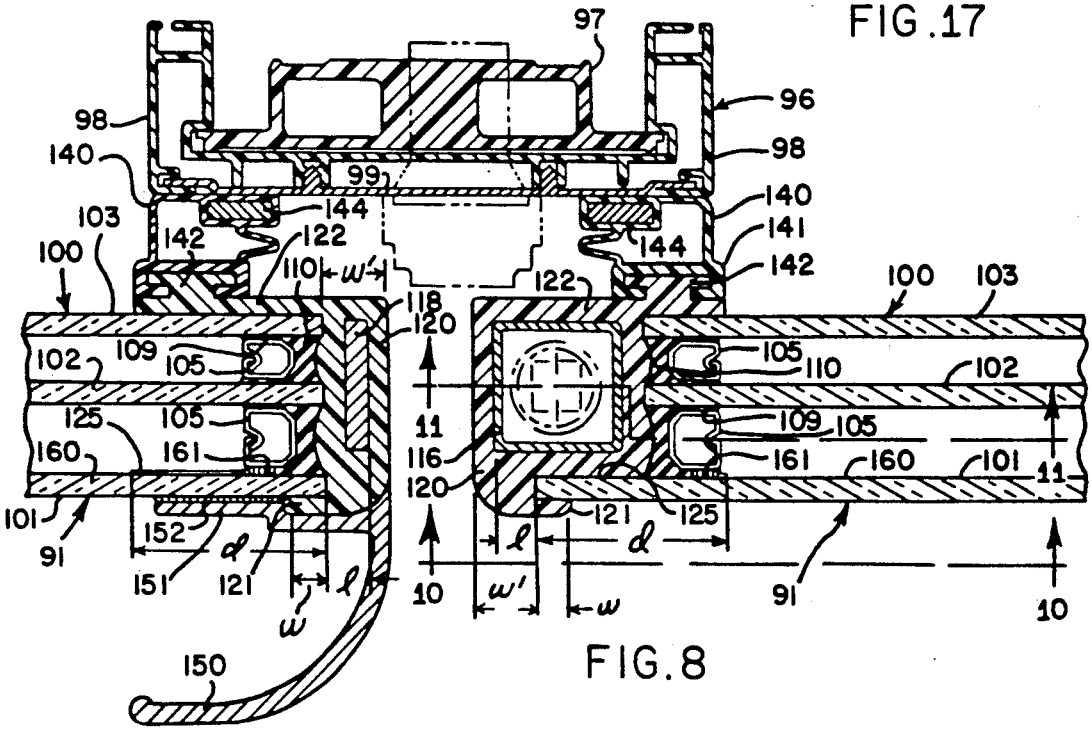
FIG. 8 is an enlarged fragmentary section taken in the plane of line 8—8 in FIG. 7.
Figure 12:
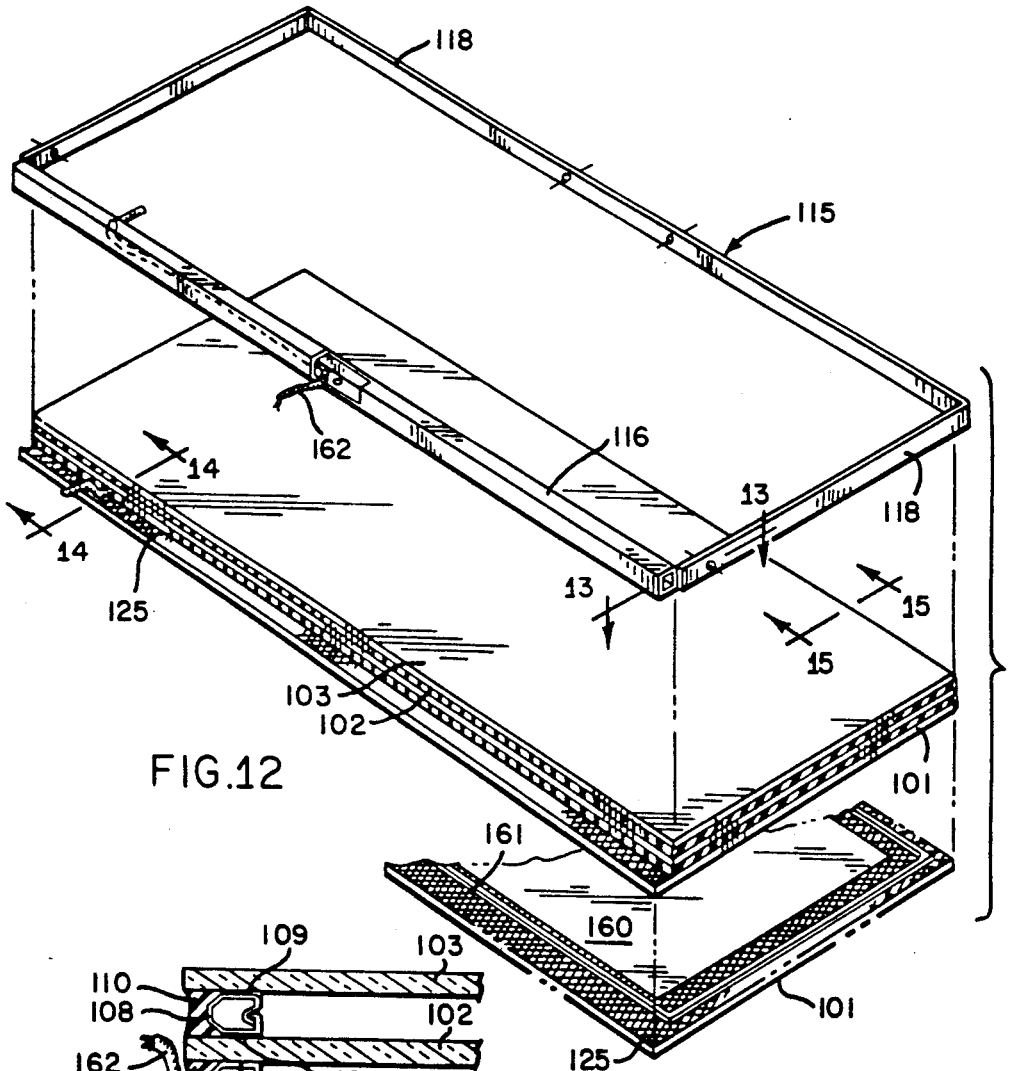
FIG. 12 is an exploded view depicting component parts of one of the insulated doors of the assembly shown in FIG. 7.

In keeping with the invention, the forward pane 101 of each door 91 again is of larger size than the panes 102, 103 rearwardly thereof for providing a modernistic, substantially all glass front appearance to the door. In this instance, to facilitate fabrication of the glass unit 101, the planes 101, 102, and 103 each are of a similar height and extend outwardly a similar distance on the free swinging side of the door. On only the hinge mounted side of the door 91 does the forward glass pane 101 extend outwardly a greater distance than the rearward panes 102, 103, as illustrated in FIG. 8. It will be appreciated that such arrangement facilitates assembly of the glass panes 101, 102, 103 enabling the top, bottom, and free swinging sides of the glass panes to be easily brought into aligned relation to each other, thereby automatically establishing the distance the forward pane 101 extends outwardly from the intermediate and rear glass panes 102, 103 on the hinge mounted side of the glass unit.

Figure 14:
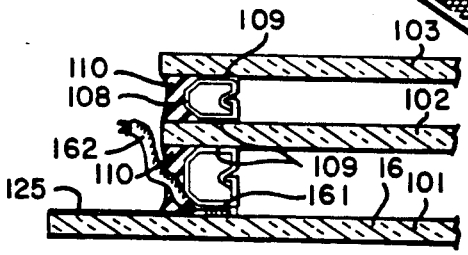
FIGS. 13-15 are enlarged fragmentary sections taken in the planes of lines 13—13, 14—14, and 15—15, respectively, in FIG. 12.
Figure 15:
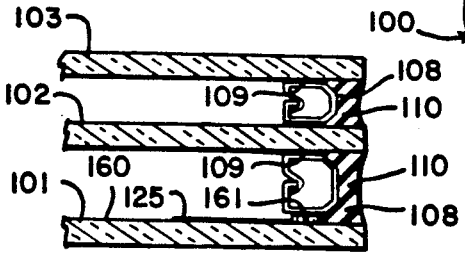
Figure 16:
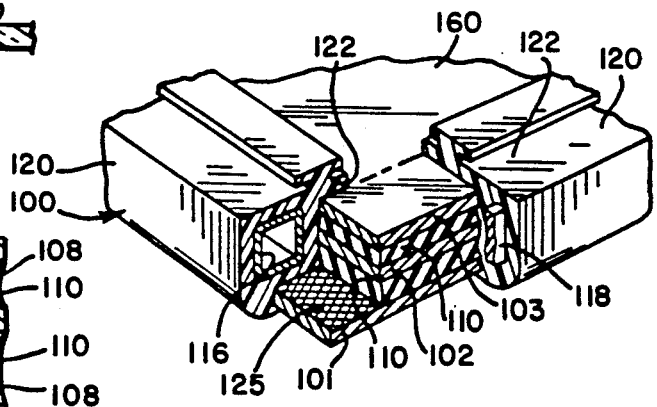
FIG. 16 is a break-away perspective depicting a corner of one of the doors.

Each spacer 105 comprises a plurality of elongated metal tubular members 105*a* connected by corner keys 106 (FIG. 11) and disposed in a rectangular arrangement between respective adjacent glass panes 101, 102, 103. Each spacer 105 is located inwardly a distance from the peripheral edges of the glass panes so as to define outwardly opening channel areas 108 (FIG. 15)

about the perimeter of the glass unit. Sealant 109 is provided between the sides of the spacers 105 and the adjacent glass panes 101, 102, 103 for establishing a primary vapor seal, and a polysulfide adhesive 110 fills the outwardly opening channel areas 108 about the perimeter of the glass unit 100 (FIGS. 14 and 15).

For providing structural support and rigidity for the glass unit 100, each door 91 has an outer frame 115 (FIG. 12) that includes an upstanding metal tubular frame member 116 on the hinge mounted side of the door and steel plate frame members 118 disposed adjacent the top, bottom and free swinging sides of the glass unit 100. The tubular and plate frame members 116, 118 are welded in a rectangular arrangement (FIGS. 12–13) and are disposed such that the tubular member 116 is located in outwardly spaced relation to the peripheral edges of the intermediate and rear glass panes 102, 103 and at least partially behind the outwardly extending peripheral edge portion of the forward glass pane 101. The tubular structural frame member 116 in this case has a portion extending laterally outwardly beyond the peripheral edge of the forward glass pane 101. The plate frame members 118 have a width corresponding to the width of the tubular frame member 116 and are disposed in outwardly spaced relation to the peripheral edges of the intermediate and rear glass panes 102, 103 in a plane rearwardly of the forward glass pane 101. The plate frame members 118 are mounted such that their outer peripheries are located a distance "1" from the outer periphery of the forward glass pane 101 similar to the distance "1" the tubular spacer member 116 extends outwardly from the forward glass pane 101 (FIG. 8).

In accordance with a further aspect of the invention, each insulated glass door 91 has a nonmetallic, lightweight outer trim portion 120 which encapsulates the outer frame 115 and the periphery of the glass unit 100 and which has insulating qualities that tend to prevent heat transfer between warm and cold sides of the door. The trim portion 120 may be molded of a foam plastic material, such as structural polyurethane foam sold by Mobay Chemical Company under the name Baydur. Alternatively, thermosetting PVC or other plastic materials could be used. The trim portion 120, which may be formed with a decorative configuration to give the door an attractive finished appearance, completely surrounds the outer frame members 116, 118 and encloses the outer periphery of the glass unit 100. The trim portion 120 in this instance is formed with inwardly extending retention lips 121, 122 encompassing opposite peripheral sides of the glass unit 100. As is known in the art, structural foam of the foregoing type may be formed with a solid, nonporous skin and a low-density microcellular core so as to combine high strength with light weight. Such trim portion 120 both forms the trim for the door and enhances the rigidity of the assembly.

In keeping with the invention, the trim portion 120 has a relatively narrow width, as established by the forward retention lip 121 and the portion extending outwardly from the peripheral edge of the forward glass pane 101, for causing the forward pane 101 to be exposed substantially to the outer perimeter of the door to provide a modernistic substantially all glass front appearance to the door. In practice, desirable results have been obtained by forming the forward lip 121 of the trim portion 122 such that it overlaps the forward glass pane a distance w about 0.187 inches and extends outwardly beyond the peripheral edge of forward glass plane a distance w' of about 0.375 inches, resulting in an over all marginal width of less than 0.6 inches. It will be appreciated that since tubular and plate frame members 116, 118 are mounted with their outer peripheries equal distances "1" from the peripheral edges of the forward glass pane 101, the trim portion 120 has a uniform appearance when viewed from a front side of the door for enhancing its aesthetic appearance. The rear retention lip 122 of the trim portion 120 may extend inwardly a greater distance than the forward lip 121 for added support of the glass unit 100 and for facilitating mounting of a sealing gasket, as will become apparent.

It will be appreciated that utilization of the molded non-metallic trim portion 120 further can facilitate economical manufacture of the insulated glass door 91. The spacers 105, and glass panes 101, 102, 103 may be assembled into an insulated glass unit 100 by currently available automated means. In contrast to labor intensive procedures for assembling conventional outer metal structural frames about such glass units, the non-metallic trim 120 may be efficiently molded about the perimeter of the glass unit 101, upon positioning of the glass unit 100 and the prefabricated outer frame 115 in an appropriate mold. As is known in the art, structural polyurethane foam can be produced by chemically reacting polyo and isocyanate and injecting such reacting mixture at atmospheric pressure into the mold. Pressure developed during expansion of the foam produces a solid, nonporous skin on the molded part and a relatively low density microcellular core.

Since the trim portion 120 may be formed of a seamless configuration, it further assists in preventing the infiltration of air and moisture into the interior of the insulated glass door. Moreover, contrary to conventional refrigerator door assemblies with metallic outer support frames, the trim portion has relatively low heat conductivity and is less susceptible to condensation and frost buildup, even without electrical heating means within the door.

For preventing viewing of the internal components of the door assembly through the forward glass pane from the front side thereof, and for enhancing the modernistic substantially all glass front appearance of the door, a peripheral masking 125 in the form of a dark silk screen or ink is applied to the inner face of the forward glass pane 101 about its marginal edge portion. As shown in FIG. 8, the masking 125 preferably extends inwardly from the peripheral edge of the forward glass pane 101 a distance "d" to the innermost edge of the spacers 105, which also corresponds to the innermost edge of the rear retention lip 122 of the trim portion 120. When looking through the front side of the door, the masking 125 conceals from view the spacers 105, the sealant 109, the polysulfide adhesive 110, and the outer frame encapsulating trim portion 120 disposed immediately behind the forward glass pane.

Figure 9:
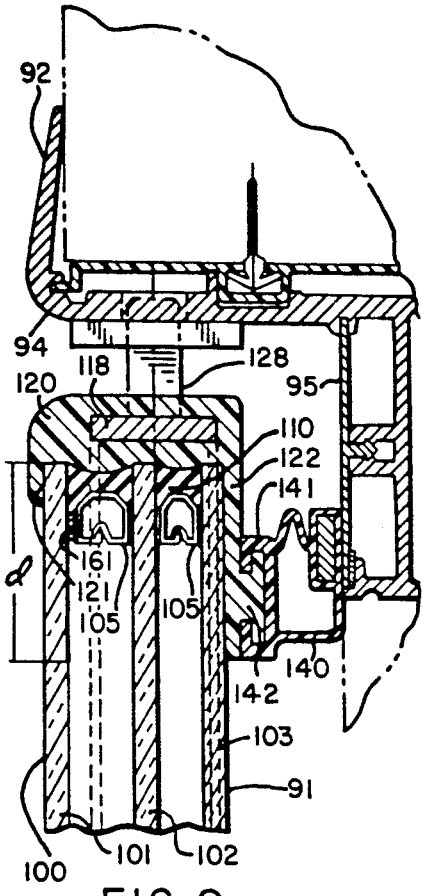
FIG. 9 is an enlarged fragmentary section taken in the plane of line 9—9 in FIG. 7.
Figure 10:
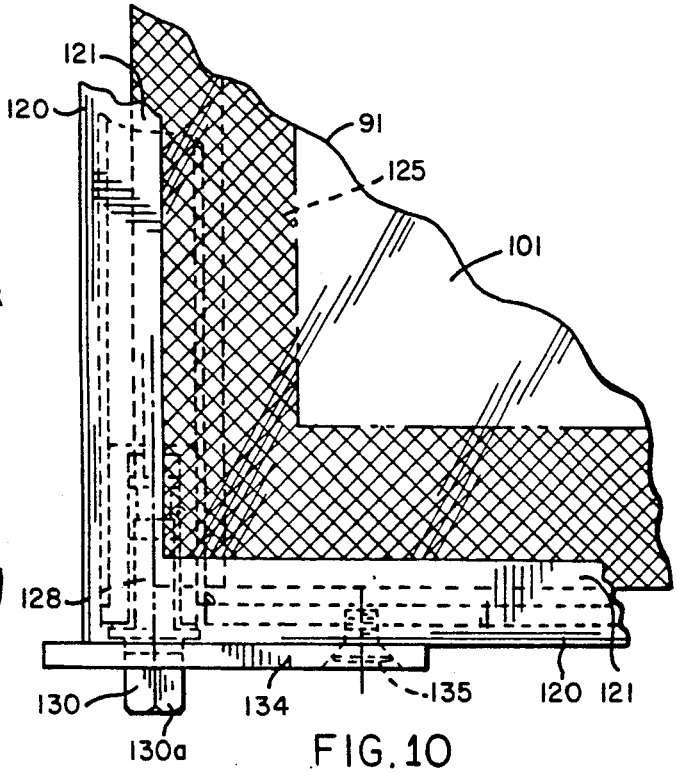
FIG. 10 is a partial plan view of a corner of one of the insulated glass doors, taken in the plane of line 10—10 in FIG. 8.
Figure 13:
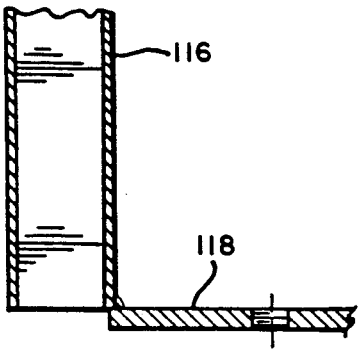
Figure 11:
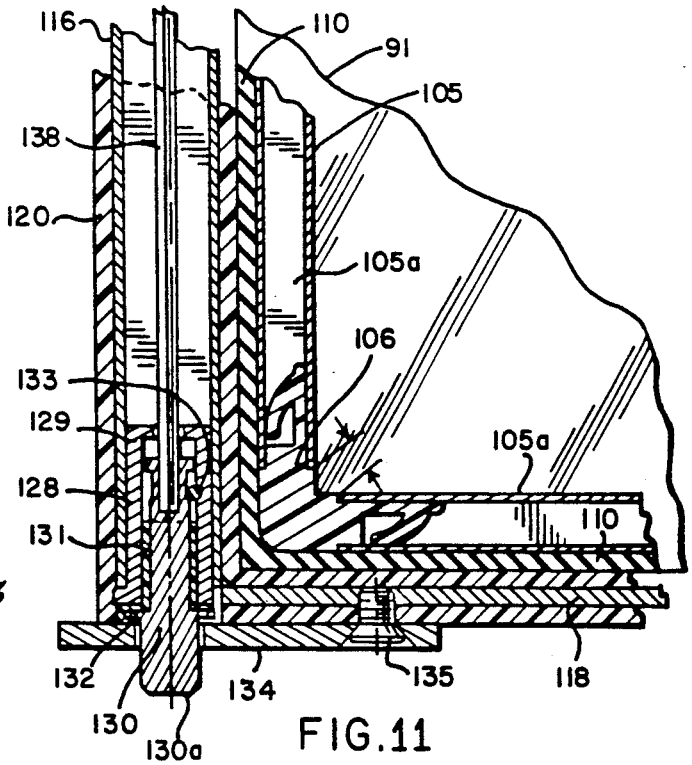
FIG. 11 is a vertical section taken in the plane of line 11—11 in FIG. 8.

For supporting each insulated glass door 91 for swinging movement, hinge assemblies 128 are provided at opposite ends of the tubular frame member 116, as best shown in FIGS. 9 and 11. The hinge assemblies 128 each include a tubular hinge block 129 welded within the end of the tubular frame member 116 and a hinge pin 130 disposed for relative rotational movement within the block. An anti-friction bushing 131 made of nylon or other suitable anti-friction material may be interposed between the block 129 and the hinge pin 130 to facilitate relative rotation of the hinge pin 130. The hinge pin 130 has an outwardly projecting flange 132 and is retained within the hinge block 129 by a pin 133 at one end and by a plate 134, such as a doorstop plate, affixed to the horizontal frame member 118 by screws 135 (FIG. 11). The hinge pin 130 has an outwardly projecting end 130*a*, preferably of square or rectangular cross section, positionable within a comparably shaped aperture in a hinge plate 134 affixed to the cabinet frame (FIG. 9). A torsion rod 138 of a conventional type is affixed to the hinge pin 130 for biasing the door toward a closed position.

For providing a seal between the door 91 and the cabinet frame 92 when the door 91 is in a closed position, a sealing gasket 140 is secured to the rear retention lip 122 of the trim portion 120. The sealing gasket 140 has a mounting bracket 141 that is positionable onto a T-shaped mounting flange 142 integrally formed on the rear side of the trim portion retention lip 122. As previously described, the sealing gasket may contain magnets 144 for creating a magnetic attraction with the cabinet frame cover plates 95, 99.

Figure 17:
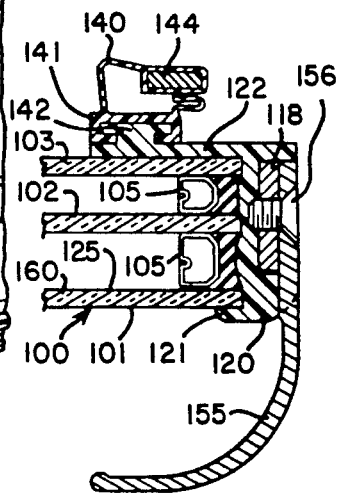
FIG. 17 is an enlarged fragmentary section showing an alternative handle mount for the insulated glass doors of the assembly shown in FIG. 7.

To facilitate opening and closing of the door 91, a handle 150 is secured to the free-swinging side of each door 91. The handle 15, as shown in FIG. 8, includes a flat mounting plate ISI affixed to the front side of the forward glass pane 101 by a double sided adhesive 152. The handle 150 further includes an outer portion formed to conform with the forward end of the molded trim portion 120 of the door. Alternatively, a handle 155 may be secured to the outer perimeter of the free swinging end of the door by means of a fastener 156 in threaded engagement with the outer frame member 118 of the door, as shown in FIG. 17.

To maintain the forward glass pane 101 in a condensation free condition for enhanced viewing through the door of products within the refrigerator or freezer case, a thin electrically conductive coating 160 is provided on the inner face of the forward glass pane 101 in a conventional manner. To permit the conduction of current across the electrically conductive coating 160, bus bars 161 are mounted on opposite sides of the coating 160, which in turn are connected to an electrical source by leads 162 (FIG. 14).

In further carrying out the invention, the bus bars 161 are disposed between the spacer 105 and the forward glass pane 101 so as to be hidden from view, and hence, not detract or reduce the viewing area of the forward glass pane 101. To permit such location of the bus bars 161 without causing current conduction through the metallic spacer members 105*a*, the corner keys 106 for the spacer members 105*a* are made of nylon or other suitable plastic or nonconductive material and support the spacer members 105*a* with their ends separated by a distance "s" of at least ¼ inch, so as to interrupt the current flow path between spacer members 105*a*, as shown in FIG. 11. In addition, the sealant 108 between the spacers 105 and the glass pane 101 is a carbon-free, non-conductive polyisolbutylene so that the bus bars 161 are in conductive relation only with the coating 160.

It will be appreciated that contrary to conventional practice of spacing the bus bars ¼ inch inwardly from the metallic spacers of the glass unit where they are noticeable on the exposed surface of the forward glass pane and effectively reduce the viewing area through the glass unit by a distance of about ½ inch on each side of the door, the door of present invention has a substantially unencumbered all glass front appearance. With the bus bars 161 located between the spacer 105 and the glass pane 101, like the other internal components about the periphery of the glass unit, they are hidden from view by the masking 125. (FIGS. 14 and 15).

From the foregoing, it can be seen that the refrigerator door assembly of the present invention has a modernistic, substantially all-glass front appearance, but retains the efficiency and structural features of conventional insulated glass doors to which the industry has grown accustom over the years. The door assembly further lends itself to economical manufacture, utilizing existing production techniques.

What is claimed is:

1. A refrigerator door assembly comprising a cabinet frame for mounting adjacent an opening of a refrigerator cabinet, an insulated glass door comprising an insulated glass unit having a plurality of glass panes disposed in side-by-side relation and including a forward pane and at least one pane disposed rearwardly of said forward pane, a spacer interposed between said panes for maintaining said panes in parallel relation with an air space therebetween, said spacer including vertical spacer elements disposed adjacent opposite sides of said glass panes and top and bottom spacer elements connected to said vertical spacer elements and disposed adjacent top and bottom ends of said glass panes, said spacer elements each having an inner peripheral edge disposed inwardly from a respective outer peripheral edge of said forward glass pane, an outer structural door support frame about the periphery of said glass unit, said structural support frame including vertical frame support elements disposed adjacent opposite sides of said door and top and bottom frame support elements disposed adjacent top and bottom ends of said door and rigidly connected to said vertical frame support elements for supporting the weight of said glass unit, said vertical frame support elements being disposed outwardly of said vertical spacer elements and said top and bottom structural frame support elements being disposed outwardly of said top and bottom spacer elements, means supporting said structural support frame and hence the glass unit supported thereby for movement relative to said cabinet frame, said forward glass pane being larger in size than said rearwardly disposed pane and extending outwardly substantially to the outer perimeter of said door, said structural support frame having at least a portion located rearwardly of a peripheral portion of said forward glass pane and being without any portion which extends in overlapping relation to a forward side of said forward pane a distance greater than the distance said rearwardly located structural support frame portion is disposed inwardly from an outer peripheral edge of said forward glass pane, and masking means about a peripheral portion of said forward glass pane and extending inwardly at least a distance corresponding to the inner peripheral edge of said spacer elements for preventing viewing of said spacer elements and the portion of said structural support frame located rearwardly of said forward glass pane through said forward glass pane from a front side thereof while permitting unobstructed viewing of an interior of the refrigerator cabinet within which said door assembly is mounted.

2. The refrigerator door assembly of claim 1 including sealant means associated with said glass panes and spacer for sealing said air space, and said masking means prevents viewing of said sealant means through said forward glass pane from a front side thereof.

3. The refrigerator door assembly of claim 1 including adhesive means between the said door support frame and an outer peripheral portion of said glass unit, and said masking means prevents viewing of said adhesive means through said forward glass pane from a front side thereof.

4. The refrigerator door assembly of claim 1 including an intermediate pane disposed between said forward and rearwardly disposed panes, and said outer door support frame is disposed outwardly of the peripheral edges of said intermediate and rearwardly disposed panes and rearwardly of an outer peripheral portion of said forward pane.

5. The refrigerator door assembly of claim 1 in which said masking means is a silk screen coating affixed to an outer peripheral portion of said forward glass pane.

6. The refrigerator door assembly of claim 5 in which said silk screen is affixed to a rear face of said forward glass pane.

7. The refrigerator door assembly of claim 1 including a relatively narrow perimeter frame portion extending forwardly of said door support frame in adjacent relation to an outer peripheral edge of said forward glass pane.

8. The refrigerator door assembly of claim 7 in which said narrow perimeter frame portion is an integral part of said door support frame.

9. The refrigerator door assembly of claim 7 including a molding interposed between said narrow perimeter frame portion and the outer peripheral edge of forward pane.

10. The refrigerator door assembly of claim 9 in which said molding has a forward end extending over a front side of said narrow perimeter frame portion of said door frame and a front side of said forward glass pane.

11. The refrigerator door assembly of claim 7 in which said door support frame has a portion extending rearwardly to a location adjacent an outer peripheral edge of said rearwardly disposed pane.

12. The refrigerator door assembly of claim 1 in which said cabinet frame and door support frame are made of metal.

13. The refrigerator door assembly of claim 1 including a molded non-metallic outer trim portion surrounding said outer frame and the periphery of said glass unit.

14. The refrigerator door assembly of claim 13 in which said trim portion is molded of structural polyurethane foam.

15. The refrigerator door assembly of claim 13 in which said trim portion is molded of thermal setting PVC plastic.

16. The refrigerator door assembly of claim 13 in which said outer frame extends outwardly beyond the periphery of said forward glass pane, and said trim portion encapsulates said outer frame.

17. The refrigerator door assembly of claim 1 in which said forward glass pane has a conductive coating on an inner surface thereof, bus bars mounted on said forward glass pane on opposite sides of said conductive coating for connection to an electrical source, and said bus bars being disposed between said spacer and said forward glass pane.

* * * * *